US005628331A

United States Patent [19]

Mengoli et al.

[11] Patent Number: 5,628,331

[45] Date of Patent: May 13, 1997

[54] METHOD AND MACHINE FOR SIMULTANEOUSLY PRODUCING A NUMBER OF CIGARETTE RODS

[75] Inventors: Fausto Mengoli, Sasso Marconi; Massimo Sartoni, Bologna; Fiorenzo Draghetti, Medicina, all of Italy

[73] Assignee: G.D Societá Per Azioni, Bologna, Italy

[21] Appl. No.: 686,525

[22] Filed: Jul. 26, 1996

[30] Foreign Application Priority Data

Jul. 27, 1995 [IT] Italy ..... BO95A0370

[51] Int. Cl.[6] ..... A24C 5/24

[52] U.S. Cl. ..... 131/67; 131/84.1

[58] Field of Search ..... 131/35, 37, 67, 131/69, 84.1–84.4, 280

[56] References Cited

U.S. PATENT DOCUMENTS 2,148,685 2/1939 Di Ianni ..... 131/69 X 3,400,007 9/1968 Rudzinat ..... 131/67 X 4,336,812 6/1982 Seragnoli ..... 131/67 X 4,917,118 4/1990 Mangiarotti ..... 131/84.1

*Primary Examiner*—Jennifer Bahr

*Attorney, Agent, or Firm*—Oblon, Spivak, McClelland, Maier & Neustadt, P.C.

[57] ABSTRACT

A method and machine whereby at least two strips of paper, after being supplied with respective continuous layers of shredded tobacco, are fed along a forming beam by respective conveyor belts which are deformed transversely to gradually wind the respective strips about the respective layers and so form respective tubular wrappings, each presenting a respective longitudinal lateral appendix, an inner lateral portion of which is gummed by a respective gumming disk and then brought into contact with an outer surface of the respective tubular wrapping to form a respective continuous cigarette rod; the inner lateral portions being gummed at an intermediate point of the forming beam. The gumming apparatus is located to one side of the forming beam, thereby leaving the other side accessible.

30 Claims, 2 Drawing Sheets

METHOD AND MACHINE FOR SIMULTANEOUSLY PRODUCING A NUMBER OF CIGARETTE RODS

BACKGROUND OF THE INVENTION

The present invention relates to a method of simultaneously producing a number of cigarette rods.

In cigarette manufacturing machines, and as described in U.S. Pat. No. 4,336,812, at least two parallel, side by side strips of paper are fed on to respective conveyor belts, the transportation branches of which extend over a forming bed and through a loading station where a central portion of each strip is fed with a respective continuous layer of shredded tobacco. Downstream from the loading station, the transportation branches of the conveyor belts engage respective variable-section grooves formed along a forming beam fitted to the forming bed, and are deformed transversely by the grooves to gradually wind the respective strips about the respective layers of tobacco to form respective tubular wrappings. Each of the wrappings presents a respective longitudinal lateral appendix, the inner surface of which is gummed by a respective gumming device and then brought into contact with the outer surface of the tubular wrapping to form a respective continuous cigarette rod.

As described in U.S. Pat. No. 4,336,812 referred to above, to simplify assembly and maintenance of the gumming devices, these are located on opposite sides of the forming beam. Such an arrangement, however, in addition to seriously complicating any intervention on the forming bed on the part of the operator, and the assembly of removable safety covers on the outward-facing part of the forming bed, also limits the location and orientation of said inner surfaces and hence the structure of the respective grooves.

To overcome this drawback, the gumming devices are therefore known to be located upstream from the loading station. Even this solution, however, is not without drawbacks, in that, on reaching the loading station, each paper strip presents a lateral portion gummed on the side facing the respective layer of tobacco, so that any stray particles of tobacco from the layer may adhere to the gummed portion of the strip, thus resulting in the formation of defective cigarettes.

SUMMARY OF THE INVENTION

It is an object of the present invention to provide a method of producing a number of continuous cigarette rods, designed to overcome the aforementioned drawbacks.

More specifically, it is an object of the present invention to provide a method enabling, firstly, the formation of a number of continuous cigarette rods while at the same time enabling free access by the operator to the rod forming bed, and, secondly, greater flexibility in the formation of the cigarette rods themselves, Yet a further object of the present invention is to provide a method enabling the structure of the gumming devices to be simplified and combined as far as possible.

According to the present invention, there is provided a method of simultaneously producing a number of cigarette rods, the method comprising the steps of feeding at least two strips of paper, by means of respective conveyor belts, along a given path extending in a given traveling direction through a loading station, each conveyor belt coming into contact with an outer surface of the relative strip; transferring a respective continuous layer of tobacco on to an inner surface of each said strip at the loading station; feeding the strips and respective layers, by means of said conveyor belts, along a forming beam; gradually deforming the conveyor belts transversely, by means of the forming beam, to gradually wind the respective strips about the respective layers and so form respective tubular wrappings presenting respective longitudinal lateral appendixes projecting outwards and presenting respective longitudinal lateral inner surface portions; gumming, on each strip, the relative said lateral inner surface portion by means of a gumming device; and turning said appendixes over on to the respective tubular wrappings to form respective continuous cigarette rods; characterized in that said lateral inner surface portions are gummed at an intermediate point of the forming beam by means of said gumming device; said gumming device being located on one side only of said forming beam.

The present invention also relates to a machine for simultaneously producing a number of cigarette rods.

According to the present invention, there is provided a machine for simultaneously producing a number of cigarette rods, the machine comprising a forming beam for forming at least two cigarette rods; a conveyor belt for each said cigarette rod, the conveyor belt being brought into contact with an outer surface of a respective strip of paper, and feeds the strip along a given path extending at least partly along said forming beam; a loading station located along said path and upstream from the forming beam in a traveling direction of the conveyor belts; supply means for transferring a respective continuous layer of tobacco on to an inner surface of each said strip at the loading station; and a gumming device for gumming a lateral inner surface portion of each strip; the forming beam presenting, for each said conveyor belt, a variable-section groove engaged by the conveyor belt and for gradually deforming the conveyor belt transversely to gradually wind the respective strip about the respective layer of tobacco so as firstly to form a respective tubular wrapping presenting a longitudinal lateral appendix projecting outwards and presenting said longitudinal lateral portion of said inner surface, and so as secondly to turn said appendix over on to the respective tubular wrapping; characterized in that said gumming device is located at an intermediate point of the forming beam; said gumming device being located on one side only of said forming beam.

BRIEF DESCRIPTION OF THE DRAWINGS

A number of non-limiting embodiments of the present invention will be described by way of example with reference to the accompanying drawings, in which:

FIGS. 4(*a*)–4(*d*) show a larger-scale view, with parts in section and parts removed for clarity, of three preferred embodiments of a detail in FIG. 3.

DETAILED DESCRIPTION OF THE INVENTION

Figures 1, 4A, 4B, 4C, 4D:
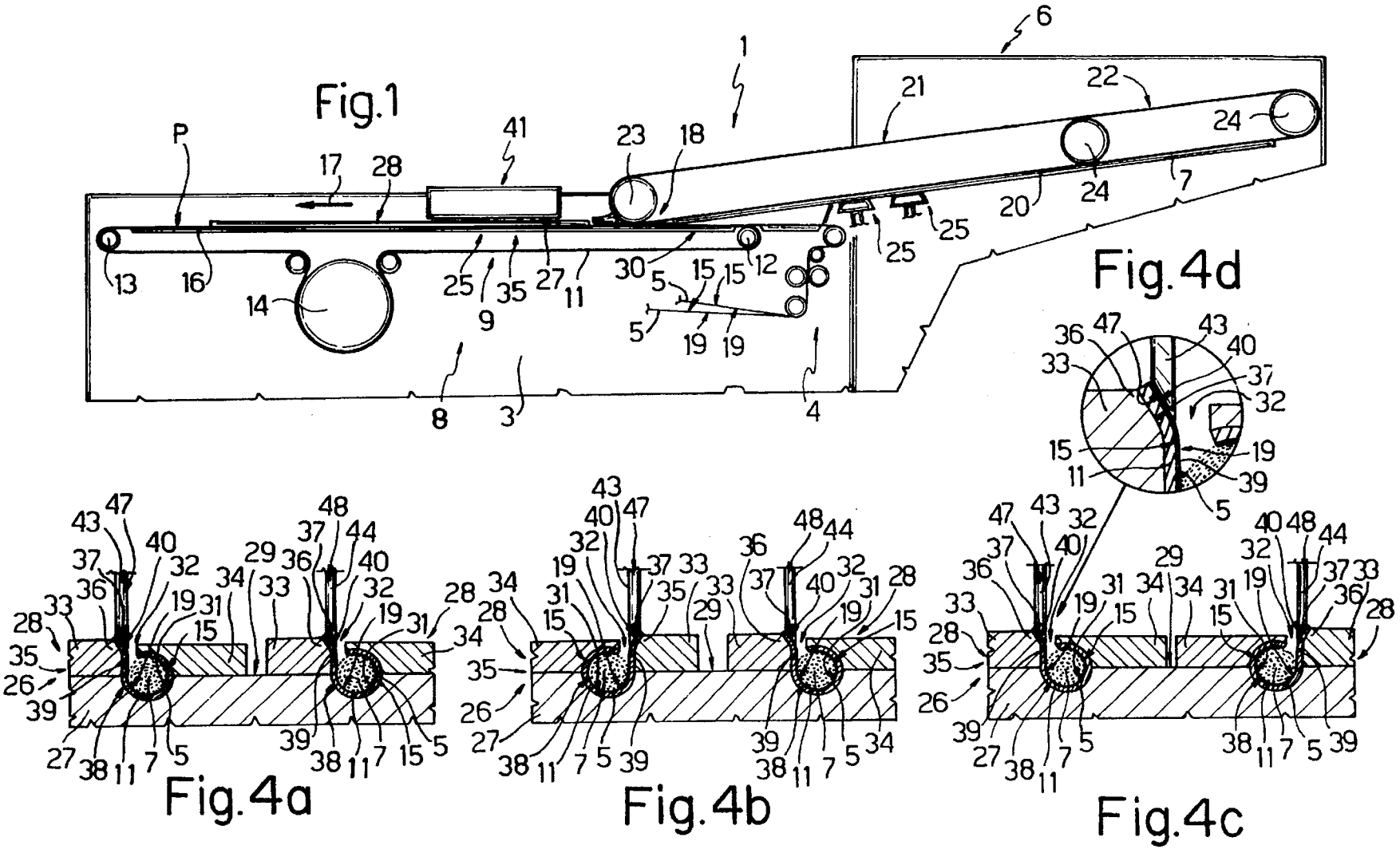
FIG. 1 shows a schematic side view, with parts removed for clarity, of a preferred embodiment of the machine according to the present invention.
Figure 3:
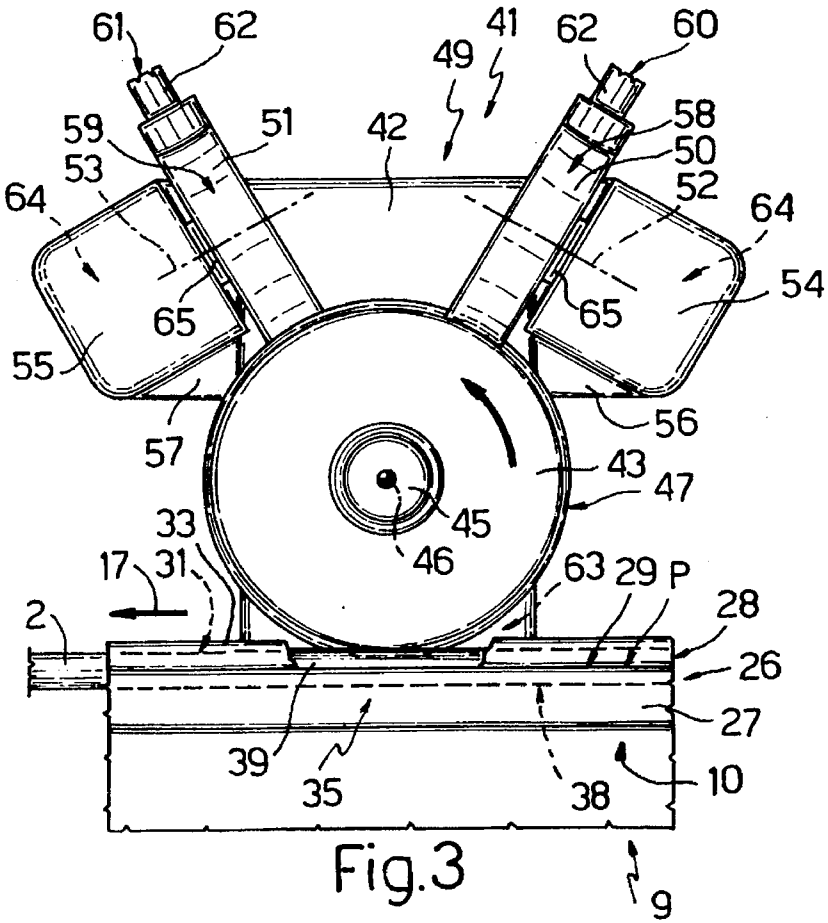
FIG. 3 shows a front view of the FIG. 2 detail.

Number 1 in FIG. 1 indicates a manufacturing machine for simultaneously producing at least two cigarette rods 2 (FIG. 3). Machine 1 comprises a supporting frame 3 supporting a known device 4 for supplying at least two paper strips 5, each slightly wider than the circumference of cigarette rods 2; a known device 6 for supplying shredded tobacco 7; and a device 8 for forming cigarette rods 2, and in turn comprising a forming bed 9 located at the top of frame 3 and presenting a free lateral surface 10 (FIG. 2) located at the front in relation to the operator (not shown) controlling machine 1, and which hereinafter is referred to as "front surface 10." Device 8 also comprises, for each strip 5, a conveyor belt 11 looped about two pulleys 12 and 13 and powered by a drive cylinder 14 to feed respective strip 5 along a given path P extending along bed 9.

Device 4 feeds each strip 5 on to respective belt 11 in such a manner that the outer surface 15 of strip 5 contacts the transportation branch 16 of belt 11, which feeds strip 5 in a given traveling direction 17 and through a loading station 18 located along path P and where a respective substantially uniform layer 20 of tobacco 7 is fed by device 6 on to the inner surface 19 of strip 5.

Layers 20 are substantially identical, and adhere to the bottom surface of the bottom branch of respective suction conveyor belts 21, 22 forming part of device 6 and extending partly over bed 9. Each conveyor belt 21, 22 slopes downwards and is looped about a bottom pulley 23 at station 18 and about a top pulley 24. Device 6 also comprises two known shaving disks 25 for shaving the bottom surface of layers 20, which are substantially narrower than respective strips 5. More specifically, when deposited on to respective strip 5, each layer 20 leaves two longitudinal lateral portions (not shown) of inner surface 19 of strip 5 exposed on either side of layer 20.

Device 8 for forming cigarette rods 2 also comprises a forming beam 26 supported on bed 9 and extending along path P, downstream from station 18 in direction 17. As shown more clearly in FIGS. 2 and 3, beam 26 comprises a bottom plate 27 and, for each belt 11, a top plate 28 supported on the top surface 29 of plate 27. More specifically, plate 27 is longer than plate 28, and presents a perfectly flat initial portion 30 projecting in relation to plate 28, located adjacent to station 18, and contacting the bottom surfaces of transportation branches 16 of belts 11.

Further away from station 18 along path P, plate 27 presents, for each belt 11, an upper groove 31 extending along path P, beneath respective belt 11, and which, in relation to surface 29, gets gradually deeper to assume a curved section with a radius of curvature varying in inverse proportion to the distance from station 18; which section eventually assumes a constant, substantially semicylindrical shape with a radius of curvature substantially equal to that of cigarette rods 2. Each plate 28 on the other hand presents a respective recess (not shown) extending along respective groove 31, and which, as of station 18, gets gradually narrower until it is eventually reduced to a straightforward vertical slit 32 defined by two lateral walls 33 and 34. Downstream from station 18 and at an intermediate portion 35 of beam 26, wall 33 presents a respective end portion 36 projecting upwards in relation to wall 34, and in turn presenting an inner surface 37 facing frame 3. Grooves 31 are substantially identical, and surfaces 37 of walls 33 both face frame 3.

Transportation branch 16 of each belt 11 extends along respective groove 31, in contact with which, branch 16 is gradually curved inwards until, cooperating with the respective said recess, it eventually assumes a substantially cylindrical shape. As a consequence of the transverse deformation of branches 16, respective strips 5 are also deformed transversely, and are wound about respective tobacco layers 20 to form respective tubular wrappings 38, each of which presents a lateral appendix 39 projecting outwards through respective slit 32, and in turn presenting a surface 40 facing away from front surface 10 and forming a longitudinal lateral portion of surface 19 corresponding to one of the two said lateral portions.

Device 8 also comprises a gumming device 41 supported on frame 3, on the same side as and at intermediate portion 35 of beam 26. Device 41 provides for gumming surfaces 40 of appendixes 39, which, immediately downstream from device 41, are turned over in known manner on to respective surfaces 15 to which they adhere to form respective cigarette rods 2.

Device 41 comprises a box element 42 located to the side of beam 26, on the opposite side to front surface 10; and two gumming disks 43, 44, each associated with a respective cigarette rod 2, and each for depositing an adhesive substance (not shown) on to respective surface 40. Disks 43, 44 are fitted facing each other on a single shaft 45, which is fitted to element 42 so as to rotate about an axis 46 crosswise to direction 17, and projects over beam 26 from element 42. Disks 43, 44 are identical, are located parallel to each other over and perpendicularly to surface 29, and are rotated anticlockwise in FIG. 3 about axis 46.

Figure 2:
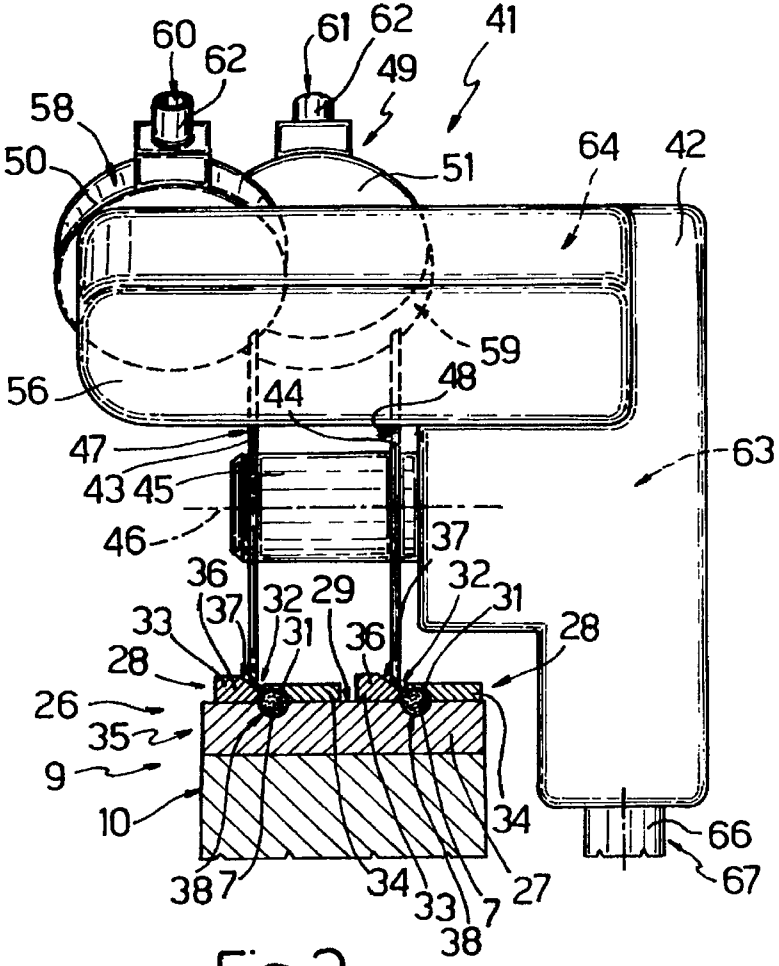
FIG. 2 shows a partly sectioned view, with parts removed for clarity, of a detail in FIG. 1.

As shown in FIGS. 2 and 4*a*, disks 43, 44 are defined externally by respective conical lateral surfaces 47, 48 coaxial with axis 46 and tangent to respective surfaces 40. More specifically, surfaces 47, 48 present their vertices (not shown) on the same side of respective disks 43, 44, and on the opposite side in relation to frame 3, which arrangement of disks 43, 44 and respective surfaces 47, 48 provides for gumming surfaces 40 substantially at the same point of forming beam 26 along path P.

Device 41 also comprises a device 49 associated with disks 43, 44, and for supplying disks 43, 44 with said adhesive substance. More specifically, device 49 comprises two gumming rollers 50, 51 associated respectively with disks 43, 44, located facing each other over disks 43, 44, and slightly offset in relation to each other crosswise to path P.

Rollers 50, 51 present respective axes 52, 53 crosswise to axis 46 and inclined in relation to surface 29, and are supported for rotation about respective axes 52, 53 by respective tubular end portions 54, 55 of respective L-shaped box arms 56, 57 extending on opposite sides of element 42, over beam 26 and crosswise to direction 17. Rollers 50, 51 present respective curved lateral surfaces 58, 59 coaxial with respective axes 52, 53, and which are supplied with said adhesive substance by respective outlet conduits 60, 61 of a known dispensing device 62. Surfaces 58, 59 are positioned contacting respective surfaces 47, 48 to apply surfaces 47, 48 with said adhesive substance.

Device 41 comprises a known mechanical transmission 63 housed inside box element 42 and presenting an output defined by shaft 45; and a mechanical transmission 64 housed inside arm 56, 57 and presenting an output defined by a shaft 65 fitted with roller 50, 51. The two transmissions 63 and 64 present a common input comprising a single shaft 66, which defines the output of a known actuating assembly 67 for simultaneously activating disks 43, 44 and rollers 50, 51 so that the directions of the tangential velocities of disks 43 and 44 at the points of contact with respective surfaces 40 are opposite to the traveling direction 17 of respective strips 5.

Operation of machine 1 is clearly discernible from the foregoing description and therefore requires no explanation. It should be pointed out, however, that the arrangement of gumming device 41 greatly simplifies any intervention on forming bed 9 on the part of the operator, as well as the assembly of removable safety covers (not shown) on the front surface 10 side of bed 9. Moreover, the specific location of device 41 along forming beam 26 provides for gumming surfaces 40 of the two strips 5 downstream from station 18, and so preventing the formation of defective cigarettes (not shown) due to shreds of tobacco of respective layers 20 adhering to surfaces 40.

FIGS. 4*b* and 4*c* show a further two arrangements of disks 43, 44 and plates 28, wherein plates 28 are substantially symmetrical in relation to a plane of symmetry (not shown) perpendicular to surface 29 and between plates 28 along path P.

As shown in FIG. 4*b*, walls 33 of plates 28 are substantially adjacent to and facing each other; walls 34 are located on the opposite side of respective walls 33 in relation to said plane of symmetry; surfaces 37 of walls 33 face opposite ways in relation to said plane of symmetry; surfaces 47 and 48 present their vertices (not shown) facing each other and said plane of symmetry; and grooves 31 therefore extend substantially symmetrically with each other along beam 26, and transversely deform respective strips 5 so that at least one of appendixes 39 (in the example shown, the appendix 39 closest to gumming device 41) is positioned with its lateral surface 40 facing away from front surface 10.

As shown in FIG. 4*c*, walls 34 of plates 28 are substantially adjacent to and facing each other; walls 33 are located on the opposite side of respective walls 34 in relation to said plane of symmetry; surfaces 37 of walls 33 face each other and said plane of symmetry; surfaces 47 and 48 present their vertices (not shown) facing away from said plane of symmetry; and, in this case also, grooves 31 therefore extend substantially symmetrically with each other along beam 26, and transversely deform respective strips 5 so that at least one of appendixes 39 (in the example shown, the appendix 39 furthest from gumming device 41) is positioned with its lateral surface 40 facing away from front surface 10.

By virtue of disks 43, 44 being substantially identical and being positioned perpendicular to surface 29, gumming device 41 may therefore be adapted extremely easily to any arrangement of plates 28; and combining the structures of disks 43, 44 and rollers 50, 51 provides not only for simplifying the design and manufacture of device 41, but also for storing fewer spare parts.

We claim:

1. A method of simultaneously producing a number of cigarette rods (2), the method comprising the steps of feeding at least two strips (5) of paper, by means of respective conveyor belts (11), along a given path (P) extending in a given traveling direction (17) through a loading station (18), each conveyor belt (11) coming into contact with an outer surface (15) of the relative strip (5); transferring a respective continuous layer (20) of tobacco (7) on to an inner surface (19) of each said strip (5) at the loading station (18); feeding the strips (5) and respective layers (20), by means of said conveyor belts (11), along a forming beam (26); gradually deforming the conveyor belts (11) transversely, by means of the forming beam (26), to gradually wind the respective strips (5) about the respective layers (20) and so form respective tubular wrappings (38) presenting respective longitudinal lateral appendixes (39) projecting outwards and presenting respective longitudinal lateral inner surface portions (40); gumming, on each strip (5), the relative said lateral inner surface portion (40) by means of a gumming device (41); and turning said appendixes (39) over on to the respective tubular wrappings (38) to form respective continuous cigarette rods (2); characterized in that said lateral inner surface portions (40) are gummed at an intermediate point (35) of the forming beam (26) by means of said gumming device (41); said gumming device (41) being located on one side only of said forming beam (26).

2. A method as claimed in claim 1, characterized in that said gumming device (41) projects over said forming beam (26).

3. A method as claimed in claim 1, characterized in that the gumming device (41) comprises, for each said conveyor belt (11), a gumming disk (43, 44) which is rotated about an axis (46) with a lateral surface (47, 48) tangent to said lateral inner surface portion (40) of the respective said appendix (39); said gumming disks (43, 44) being both located over said forming beam (26); and said axis (46) extending over the forming beam (26) and crosswise to said traveling direction (17).

4. A method as claimed in claim 3, characterized in that said gumming disks (43, 44) are identical.

5. A method as claimed in claim 3, characterized in that said gumming disks (43, 44) are substantially parallel to each other.

6. A method as claimed in claim 3, characterized in that said gumming disks (43, 44) are are positioned substantially coincident with each other along said path (P).

7. A method as claimed in claim 3, characterized in that each gumming disk (43, 44) is so rotated that, at a point of tangency of said gumming disk (43, 44) with said lateral inner surface portion (40) of the respective said appendix (39), said gumming disk (43, 44) presents a surface speed in the opposite direction to said traveling direction (17).

8. A method as claimed in claim 1, characterized in that the strips (5) are so deformed transversely that the lateral inner surface portions (40) of said appendixes (39) all face the same way.

9. A method as claimed in claim 8, characterized in that the lateral inner surface portions (40) of said appendixes (39) face away from a front surface (10), substantially parallel to the forming beam (26), of a forming bed (9) supporting said forming beam (26).

10. A method as claimed in claim 1, characterized in that the strips (5) are so deformed transversely that at least one of said lateral inner surface portions (40) of said appendixes (39) faces away from a front surface (10), substantially parallel to the forming beam (26), of a forming bed (9) supporting said forming beam (26).

11. A method as claimed in claim 10, characterized in that said lateral inner surface portions (40) face one one way and the other the opposite way in relation to said front surface (10) of the forming bed (9).

12. A method of simultaneously producing a number of cigarette rods (2), the method comprising the steps of feeding at least two strips (5) of paper, by means of respective conveyor belts (11), along a given path (P) extending in a given traveling direction (17) through a loading station (18), each conveyor belt (11) coming into contact with an outer surface (15) of the relative strip (5); transferring a respective continuous layer (20) of tobacco (7) on to an inner surface (19) of each said strip (5) at the loading station (18); feeding the strips (5) and respective layers (20), by means of said conveyor belts (11), along a forming beam (26); gradually deforming the conveyor belts (11) transversely, by means of the forming beam (26), to gradually wind the respective strips (5) about the respective layers (20) and so form respective tubular wrappings (38) presenting respective longitudinal lateral appendixes (39) projecting outwards and presenting respective longitudinal lateral inner surface portions (40); gumming, on each strip (5), the relative said lateral inner surface portion (40) by means of a gumming device (41); and turning said appendixes (39) over on to the respective tubular wrappings (38) to form respective continuous cigarette rods (2); characterized in that said lateral inner surface portions (40) are gummed at an intermediate point (35) of the forming beam (26) by means of said gumming device (41); the gumming device (41) comprising, for each said conveyor belt (11), a gumming disk (43, 44) which is rotated about an axis (46) with a lateral surface (47, 48) tangent to said lateral inner surface portion (40) of the respective said appendix (39); the gumming disks (43, 44) being both located over said forming beam (26); and said axis (46) extending over the forming beam (26) and crosswise to said traveling direction (17).

13. A machine (1) for simultaneously producing a number of cigarette rods (2), the machine (1) comprising a forming beam (26) for forming at least two cigarette rods (2); a conveyor belt (11) for each said cigarette rod (2), the conveyor belt (11) being brought into contact with an outer surface (15) of a respective strip (5) of paper, and feeds the strip (5) along a given path (P) extending at least partly along said forming beam (26); a loading station (18) located along said path (P) and upstream from the forming beam (26) in a traveling direction (17) of the conveyor belts (11); supply means (6) for transferring a respective continuous layer (20) of tobacco (7) on to an inner surface (19) of each said strip (5) at the loading station (18); and a gumming device (41) for gumming a lateral inner surface portion (40) of each strip (5); the forming beam (26) presenting, for each said conveyor belt (11), a variable-section groove (31) engaged by the conveyor belt (11) and for gradually deforming the conveyor belt (11) transversely to gradually wind the respective strip (5) about the respective layer (20) of tobacco so as firstly to form a respective tubular wrapping (38) presenting a longitudinal lateral appendix (39) projecting outwards and presenting said longitudinal lateral portion (40) of said inner surface (19), and so as secondly to turn said appendix (39) over on to the respective tubular wrapping (38); characterized in that said gumming device (41) is located at an intermediate point (35) of the forming beam (26); said gumming device (41) being located on one side only of said forming beam (26).

14. A machine as claimed in claim 13, characterized in that said gumming device (41) projects over said forming beam (26).

15. A machine as claimed in claim 13, characterized in that the gumming device (41) comprises, for each said conveyor belt (11), a gumming disk (43, 44) presenting an axis (46) of rotation, and a lateral surface (47, 48) tangent, in use, to said lateral inner surface portion (40) of the respective said appendix (39); the gumming disks (43, 44) being both located over said forming beam (26); and said axis (46) extending over the forming beam (26) and crosswise to said traveling direction (17).

16. A machine as claimed in claim 15, characterized in that said gumming disks (43, 44) are identical.

17. A machine as claimed in claim 15, characterized in that said gumming disks (43, 44) are substantially parallel to each other.

18. A machine as claimed in claim 15, characterized in that said gumming disks (43, 44) are positioned substantially coincident with each other along said path (P).

19. A machine as claimed in claim 15, characterized in that each gumming disk (43, 44) is so rotated that, at a point of tangency of said gumming disk (43, 44) with said lateral inner surface portion (40) of the respective said appendix (39), said gumming disk (43, 44) presents a surface speed in the opposite direction to said traveling speed (17).

20. A machine as claimed in claim 13, characterized in that said grooves (31) are substantially identical to transversely deform the respective strips (5) in such a manner that said appendixes (39) are positioned with said lateral inner surface portions (40) all facing the same way.

21. A machine as claimed in claim 20, characterized in that said grooves (31) are so formed as to position said appendixes (39) with said lateral inner surface portions (40) facing away from a front surface (10), substantially parallel to the forming beam (26), of the machine (1).

22. A machine as claimed in claim 13, characterized in that said grooves (31) extend along the forming beam (26) to transversely deform the respective strips (5) so that at least one of said appendixes (39) is positioned with said lateral inner surface portion (40) facing away from a front surface (10), substantially parallel to the forming beam (26), of the machine (1).

23. A machine as claimed in claim 22, characterized in that said grooves (31) are so formed as to position said appendixes (39) with said lateral inner surface portions (40) respectively facing away from and towards said front surface (10).

24. A machine as claimed in claim 15, characterized in that, in addition to said gumming disks (43, 44), said gumming device (41) comprises an actuating assembly (67) and a drive shaft (45) common to both said gumming disks (43, 44), a first transmission (63) being interposed between the actuating assembly (67) and the drive shaft (45) to rotate the gumming disks (43, 44) about said axis (46); and dispensing means (49) for applying adhesive material on to said lateral surfaces (47, 48) of the gumming disks (43, 44).

25. A machine as claimed in claim 24, characterized in that said dispensing means (49) comprise, for each gumming disk (43, 44), a respective gumming roller (50, 51) tangent to the lateral surface (47, 48) of the gumming roller (43, 44); and a second transmission (64) for rotating the gumming roller (50, 51) about an axis (52, 53) substantially crosswise to the axis (46) of the gumming disks (43, 44).

26. A machine as claimed in claim 25, characterized in that said second transmission (64) is interposed between the gumming roller (50, 51) and said actuating assembly (67).

27. A machine as claimed in claim 26, characterized in that said actuating assembly (67) presents a single output shaft (66) common to the first (63) and second (64) transmission.

28. A machine as claimed in claim 25, characterized in that said gumming device (41) comprises a casing (42) housing said first transmission (63); said casing (42) being located to the side of said forming beam (26) and on the opposite side to a front surface (10), substantially parallel to the forming beam (26), of the machine (1).

29. A machine as claimed in claim 28, characterized in that said transmissions extend laterally from said casing (42), one upstream and the other downstream in relation to said traveling direction (17) of said conveyor belts (11).

30. A machine (1) for simultaneously producing a number of cigarette rods (2), the machine (1) comprising a forming beam (26) for forming at least two cigarette rods (2); a conveyor belt (11) for each said cigarette rod (2), the conveyor belt (11) being brought into contact with an outer surface (15) of a respective strip (5) of paper, and feeds the strip (5) along a given path (P) extending at least partly along said forming beam (26); a loading station (18) located along said path (P) and upstream from the forming beam (26) in a traveling direction (17) of the conveyor belts (11); supply means (6) for transferring a respective continuous layer (20) of tobacco (7) on to an inner surface (19) of each said strip (5) at the loading station (18); and a gumming device (41) for gumming a lateral inner surface portion (40) Of each strip (5); the forming beam (26) presenting, for each said conveyor belt (11), a variable-section groove (31) engaged by the conveyor belt (11) and for gradually deforming the conveyor belt (11) transversely to gradually wind the respective strip (5) about the respective layer (20) of tobacco so as firstly to form a respective tubular wrapping (38) presenting a longitudinal lateral appendix (39) projecting outwards and presenting said longitudinal lateral portion (40) of said inner surface (19), and so as secondly to turn said appendix (39) over on to the respective tubular wrapping (38); characterized in that said gumming device (41) is located at an intermediate point (35) of the forming beam (26); said gumming device (41) comprising, for each said conveyor belt (11), a gumming disk (43, 44) presenting an axis (46) of rotation, and a lateral surface (47, 48) tangent, in use, to said lateral inner surface portion (40) of the respective said appendix (39); the gumming disks (43, 44) being both located over said forming beam (26); and said axis (46) extending over the forming beam (26) and crosswise to said traveling direction (17).

* * * * *